US006058530A

United States Patent [19]

Wheeler

[11] Patent Number: 6,058,530

[45] Date of Patent: May 9, 2000

[54] SECURITY SPORT TOTE TOWEL

[76] Inventor: Jerald W. Wheeler, 2015 27th Ave., Greeley, Colo. 80631

[21] Appl. No.: 08/729,439

[22] Filed: Oct. 11, 1996

Related U.S. Application Data

[63] Continuation of application No. 29/042,615, Aug. 14, 1995, abandoned.

[51] Int. Cl.[7] ..... A47G 9/06

[52] U.S. Cl. ..... 5/417; 5/419; 5/922

[58] Field of Search ..... 5/417, 419, 420, 5/922, 923, 413 R; D6/596

[56] References Cited

U.S. PATENT DOCUMENTS

| | | | |
|---|---|---|---|
| D. 341,513 | 11/1993 | Reeves et al. | D6/596 |
| D. 349,625 | 8/1994 | Dapalma | D6/596 |
| D. 372,215 | 7/1996 | Lunde | D6/596 X |
| 4,231,125 | 11/1980 | Tittl | 5/419 |
| 4,991,245 | 2/1991 | Franco | 5/419 |
| 5,072,467 | 12/1991 | Hunt | 5/417 |
| 5,266,378 | 11/1993 | Stephenson et al. | 428/156 |
| 5,361,435 | 11/1994 | Reeves | 5/419 |
| 5,467,487 | 11/1995 | Sicard | 5/419 |

FOREIGN PATENT DOCUMENTS

| | | | |
|---|---|---|---|
| 2517191 | 6/1983 | France | 5/419 |
| 864314 | 7/1957 | Germany | 5/419 |
| 544077 | 12/1957 | Italy | 5/419 |
| 77288 | 8/1950 | Norway | 5/419 |
| 253404 | 6/1926 | United Kingdom | 5/485 |

*Primary Examiner*—Terry Lee Melius
*Assistant Examiner*—James M Hewitt
*Attorney, Agent, or Firm*—Flanagan & Flanagan; John R. Flanagan; John K. Flanagan

[57] ABSTRACT

A security sport tote towel includes a main body having a pair of opposite ends and a pair of opposite sides, a pair of side-by-side corner pockets formed by an end portion of the main body adjacent to one of the opposite ends thereof and extending between the opposite sides thereof and an opposite end pocket formed by an opposite end portion of the main body adjacent to the other of the pair of opposite ends thereof and extending between the opposite sides thereof.

8 Claims, 1 Drawing Sheet

SECURITY SPORT TOTE TOWEL

This application is a continuation of design application Ser. No. 29/042,615, filed Aug. 14, 1995, now abandoned.

BACKGROUND OF THE INVENTION

The present invention relates to a terry cloth velure fabric constructed such that pockets are at the corners, for securing and organizing loose items during physical activities or for infant toddler care, and a flap is formed parallel with the top pockets for slipping the invention over a work out bench or chair.

SUMMARY OF THE INVENTION

It is the object of the invention to provide secure places to hold items during physical activities requiring, or suggesting, pocketless garments and to provide a clean intermediary material against common work out benches or the ground and floor.

A further object of the invention is to provide an after shower/bath, pool or beach wrap-around garment for the body.

BRIEF DESCRIPTION OF THE DRAWINGS

The present invention will be more fully understood by reference to the following detailed description thereof when read in conjunction with the attached drawing, and wherein.

DETAILED DESCRIPTION OF THE INVENTION

Top Pockets

Figure 1:
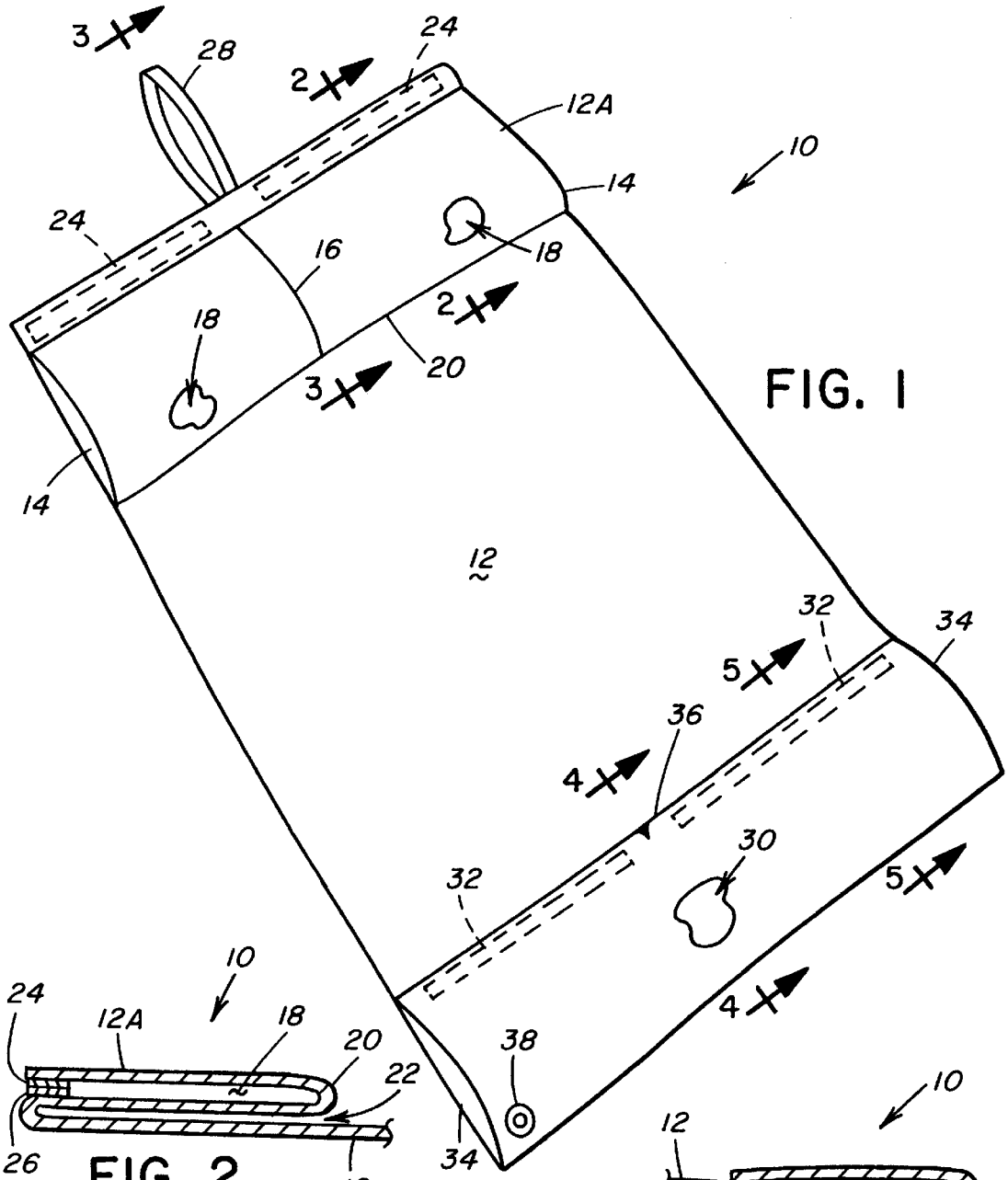
FIG. 1 is a top perspective view of the security sport tote towel of the invention.
Figure 2:
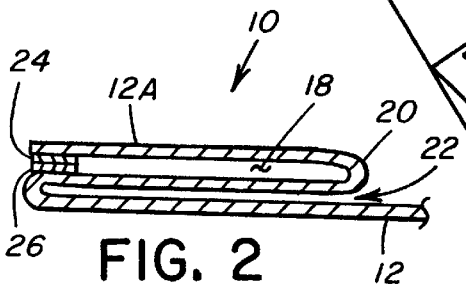
FIG. 2 is an enlarged sectional of the towel taken along line 2—2 of FIG. 1.
Figure 3:
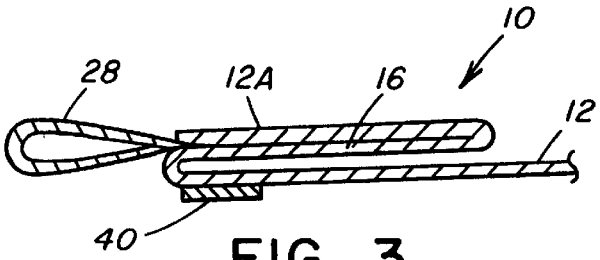
FIG. 3 is an enlarged sectional view of the towel taken along line 3—3 of FIG. 1.

FIGS. 1 to 3 illustrate the security sport tote velure or terry-cloth towel, generally designated 10, having a main body 12 whose top part 12A is folded over and sewn:

1. at the top sides 14; and 2. in the top middle 16 forming two (2) outside top corner side-by-side pockets 18.

Items such as a wallet, keys, pager, portable radio-tape player or phone, diapers, pins, golf tees, etc. are secured in the pockets 18 during work-out, travel, outings or play.

A second folding over at the top part 12A of the main body 12 of the towel 10 provides a flap 20 that forms a larger middle section 22, between the pockets and a padded section for a headrest (that is attached to the main body 12 of the towel 10). This middle section allows the towel 10 to slip over a work out bench, car seat or small chair.

Making Top Pockets 18

Start with velure side down.

Take top of terry cloth and attached two three-inch strips 24 of hook or loop releasable fastening material two inches in from the edge on both top sides 14. Fold six inches of top part 12 of terry cloth over. Sew corresponding strips 26 of hook or loop releasable fastening material.

Sew three seams; one on each top side 14 (six inches) and down the top middle 16 six inches. Fold this section over again eight-inches down (adding two-inches at the top). Sew only the top sides 14 and then turn inside out. Attach padding to body.

Handle

A strap forming a circular handle 28 is attached to the top of the towel 10 intersecting the towel 10 and forming a means of easy portage. The towel 10 can be rolled up into a cylindrical shape and slipped through the handle 28 or carried loose and hanging for ready drying of skin and/or hair, draping or hanging up off the floor or ground.

Making the Handle 28

Attach one end of the webbing to the middle two-inches of terry cloth at the top (on the non-velure side). Attach the outer end of the webbing to the opposite sides of the terry cloth (making a circle). Then sew down top the two-inches on the sides creating a flap for the pockets.

Bottom Pocket

Figure 4:
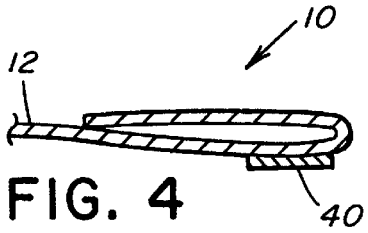
FIG. 4 is an enlarged sectional view of the towel taken along line 4—4 of FIG. 1.
Figure 5:
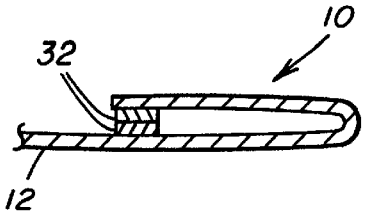
FIG. 5 is an enlarged sectional view of the towel taken along line 5—5 of FIG. 1.

FIGS. 1, 4 and 5 illustrate a bottom pocket 30 of the towel 10. The bottom pocket 30 is formed as follows. With the velure side up, sew strips 32 of hook or loop releasable fastening material as before two-inches in from the bottom sides 34. Now, sew the corresponding hook or loop material ten-inches from the bottom.

Turn the whole towel over putting the velure side down. Fold up the bottom five-inches and sew up the sides.

Then turn inside out and stitch at the bottom middle 36 of the newly formed bottom pocket 30 directly at center. Do not sew all five inches completely to the bottom of the towel 10. The bottom pocket 30 thus formed is longer in order to slip in larger items than the top pockets 18 would allow.

A grommet 38 is attached at the corner for easy golf or tennis, football or poolside hanging.

Strips 40 of hook or loop releasable fastening material and snaps are also attached at the top and bottom of one side to form a post shower/bath, poolside or beach "wrap-around" at the waist, for men, and under the arms for women (this is with a large design of the invention).

What is claimed is:

1. A security sport tote towel, comprising:

(a) a main body having a pair of opposite ends and a pair of opposite sides;

(b) a pair of side-by-side corner end pockets formed by an end portion of said main body, which is adjacent to one of said opposite ends of said main body and extends between said opposite sides thereof, the end portion being folded once over itself and by attachment elements attaching said once folded end portion of said main body to itself along said opposite sides and at a middle section of said end portion of said main body, each of said corner end pockets having edge portions defining an opening extending along said one of said opposite ends of said main body;

(c) means for releasably fastening said edge portions of each of said corner end pockets; and (d) a flap adapted to provide a head rest being formed by said once folded over end portion, having said corner end pockets formed therein, being folded again over itself and by attachment elements attaching the twice folded end portion along said opposite sides and said one opposite end of said main body.

2. The towel of claim 1 further comprising:

a handle attached to said middle section of said end portion of main body at said one of said opposite ends thereof.

3. The towel of claim 2 wherein said handle is a generally circular strap.

4. The towel of claim 1 wherein said means for releasably fastening said edge portions of each of said corner end pockets are strips of hook and loop releasable fastening material.

5. A security sport tote towel, comprising:

(a) a main body having a pair of opposite ends and a pair of opposite sides;

(b) a pair of side-by-side corner end pockets formed by an end portion of said main body, which is adjacent to one of said opposite ends of said main body and extends between said opposite sides thereof, the end portion being folded once over itself and by attachment elements attaching said once folded end portion of said main body to itself along said opposite sides and at a middle section of said end portion of said main body, each of said corner end pockets having edge portions defining an opening extending along said one of said opposite ends of said main body;

(c) first means for releasably fastening said edge portions of said each of said corner pockets;

(d) a flap adapted to provide a head rest being formed by said once folded over end portion, having said corner end pockets formed therein, being folded again over itself and by attachment elements attaching the twice folded end portion along said opposite sides and said one opposite end of said main body;

(e) an opposite end pocket formed by an opposite end portion of said main body adjacent to the other of said opposite ends thereof and extending between said opposite sides thereof, said end pocket having edge portions defining an opening disposed opposite from said one of said opposite ends of said main body, said edge portions at a middle section of said main body being fixedly attached together; and (f) second means for releasably fastening said edge portions of said end pocket between said opposite sides and said fixedly attached middle thereof.

6. The towel of claim 5 further comprising:

a handle attached to said middle section of said end portion of main body at said one of said opposite ends thereof.

7. The towel of claim 6 wherein said handle is a generally circular strap.

8. The towel of claim 5 wherein said opposite end portion of said main body is folded once over itself and has attachment elements attaching said main body to itself at said opposite end portion along said opposite sides of said main body and along said other of said opposite ends thereof so as to form said end pocket.

* * * * *